US007063652B1

(12) United States Patent
Teeter et al.

(10) Patent No.: US 7,063,652 B1
(45) Date of Patent: Jun. 20, 2006

(54) TILTABLE EXERCISER HAVING FIXED CONTROL DEVICE

(76) Inventors: Roger C. Teeter, 20720 Snag Island Dr., Sumner, WA (US) 98390; Lo Pin Wang, 16F-2, No. 17, Lane 52, Sec. 3, Rehe Road, Beitun Chu, Taichung 406 (TW)

( * ) Notice: Subject to any disclaimer, the term of this patent is extended or adjusted under 35 U.S.C. 154(b) by 0 days.

(21) Appl. No.: 10/963,015

(22) Filed: Oct. 12, 2004

(51) Int. Cl.
*A63B 26/00* (2006.01)

(52) U.S. Cl. ..... 482/145; 482/146; D21/689

(58) Field of Classification Search ..... 482/144–145; D21/686–690
See application file for complete search history.

(56) References Cited

U.S. PATENT DOCUMENTS 5,575,745 A 11/1996 Lin ..... 482/144
5,885,197 A * 3/1999 Barton ..... 482/144
2003/0162639 A1* 8/2003 Hsien ..... 482/144
2004/0157714 A1* 8/2004 Huang ..... 482/144

* cited by examiner

*Primary Examiner*—Lori Amerson
(74) *Attorney, Agent, or Firm*—Charles E. Baxley

(57) ABSTRACT

A tilting inversion exerciser includes a stand having an axle, and a table rotatably attached to the axle of the stand, to support a user, a driving device attached to the table and having a reduction gearing coupled to the axle, to drive and rotate the table relative to the stand, and a control device for controlling the driving device to rotate the table relative to the stand. The stand includes a latch engaged with the axle, to secure the axle to the stand, and to prevent the axle from being rotated relative to the stand. The stand includes an apex-connecting plate to support the axle and having a hub to rotatably receive the axle. A switch may be disposed on the table, and actuatable by an actuator device, to position the table to the stand at selected angular position.

6 Claims, 8 Drawing Sheets

TILTABLE EXERCISER HAVING FIXED CONTROL DEVICE

BACKGROUND OF THE INVENTION

1. Field of the Invention

The present invention relates to a tiltable or a tilting inversion exerciser, and more particularly to a tilting inversion exerciser having a fixed control device for preventing the fixed control device from being separated from users, and for allowing the fixed control device to be easily operated by the users.

2. Description of the Prior Art

Various kinds of typical inversion suspension exercisers, rotational exercisers, tilting inversion exercisers etc. have been developed and comprise a table rotatably or pivotally attached to a support, and rotatable relative to the support for conducting various inversion or suspension exercises.

For example, U.S. Pat. No. 5,575,745 to Lin discloses one of the typical inversion suspension exercisers, and comprises a rotatational frame pivotally attached to a support with pivots, for allowing the users to rotate the frame relative to the support.

However, the typical inversion suspension exercisers do not have any control device to control the rotational movement of the frame relative to the support, such that the users may have to use their own weight and their strength to operate the conventional tilting inversion exercisers and to conduct the typical rotational or inversion exercises.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including a driving motor to drive or to rotate the table relative to the stand to selected angular position.

The other objective of the present invention is to provide a tilting inversion exerciser including a fixed control device for preventing the fixed control device from being separated from users, and for allowing the fixed control device to be easily operated by the users.

In accordance with one aspect of the invention, there is provided a tilting inversion exerciser comprising a stand including an axle disposed thereon, a table rotatably attached to the axle of the stand, to support a user, a driving device attached to the table and including a reduction gearing coupled to the axle, to drive and rotate the table relative to the stand, and a control device for controlling the driving device to rotate the table relative to the stand.

The table includes at least one hand grip for being grasped by the user. The control device includes an electric cable coupled to the driving device, to operate the driving device. The electric cable is engaged through the hand grip.

The table includes at least one frame disposed thereon, and the hand grip is extended from the frame. The electric cable may be engaged through the hand grip and the frame. The control device may be secured to the hand grip.

The table includes a foot retaining device attached thereto, to retain feet of the user to the table. The stand includes two frames pivotally attached together, and at least one foldable link coupled between the frames to retain the frames in an open position, and to allow the frames to be folded relative to each other to a folding position.

The stand includes a latch engaged with the axle, to secure the axle to the stand, and to prevent the axle from being rotated relative to the stand. The stand includes an apex-connecting plate disposed thereon, to support the axle. The apex-connecting plate includes a hub, the axle is rotatably received in the hub of the apex-connecting plate.

The table includes a switch disposed thereon, and an actuator device for actuating the switch to stop the driving device and to position the table to the stand at selected angular position. The actuator device includes an actuator finger attached to the axle and rotated in concert with the axle, for being rotated by the axle to actuate the switch.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
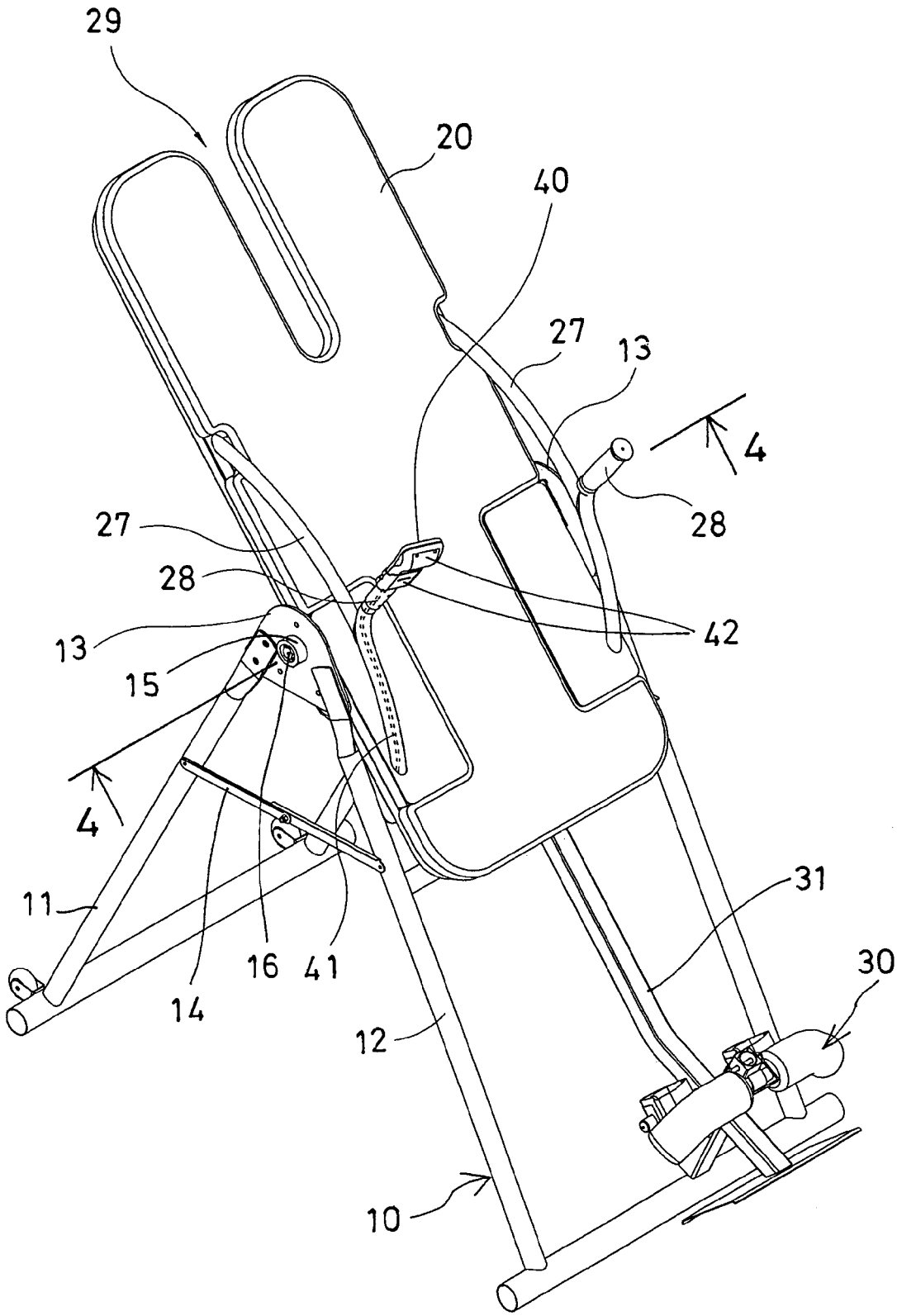
FIG. 1 is an upper perspective view of a tilting inversion exerciser in accordance with the present invention.
Figure 2:
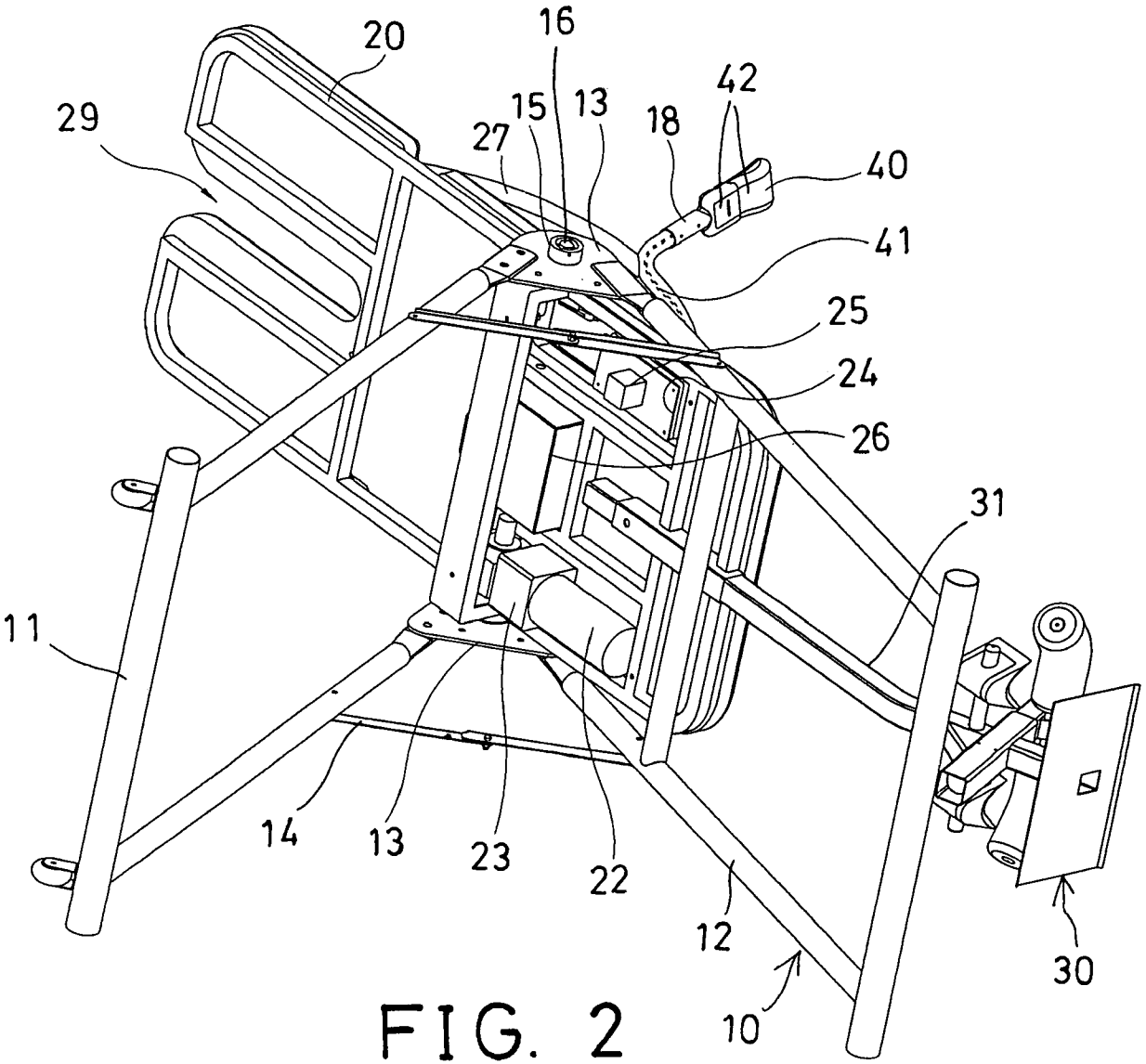
FIG. 2 is a bottom perspective view of the tilting inversion exerciser.

Referring to FIGS. 1–4, a tilting inversion exerciser in accordance with the present invention comprises a stand 10 including two frames 11, 12 pivotally attached together with two apex-connecting plates 13, and one or more foldable links 14 coupled between the frames 11, 12, to retain the frames 11, 12 of the stand 10 in an open or working position as shown in FIGS. 1, 2, and 5–8. The links 14 are also foldable for allowing the frames 11, 12, to be folded relative to the plates 13 to a folding or receiving position (not shown). The foldable stand 10 is typical and will not be described in further details.

Each of the apex-connecting plates 13 includes a hub 15 provided or extended therein, for rotatably receiving an axle 16 therein with one or more bearings 17. The axles 16 may also be formed integral with each other to form a one-integral piece axle 16. One or more latches 18 may be engaged through the hubs 15, and engaged with or keyed to the axles 16, best shown in FIG. 4, to selectively secure the axles 16 to the hubs 15 of the apex-connecting plates 13, and to prevent the axles 16 from being rotated relative to the hubs 15 of the apex-connecting plates 13.

A table 20 is rotatably or pivotally attached to the plates 13 of the stand 10 with the pivot axles 16 and/or one or more bearings 21 (FIG. 4), for allowing the table 20 to be rotated relative to the stand 10 with or about the pivot axles 16. A driving device 22, such as a motor 22 is attached to the table 20, and includes a coupling or transmission device or reduction gearing 23 coupled to or engaged with one of the axles 16, in order to drive or to rotate the table 20 relative to the stand 10 about the pivot axle 16. It is preferable that the table 20 may be rotated or driven by the motor 22 in either positive or opposite direction.

The table 20 may further include an electric control unit or box 24 attached thereto and having a transformer 25 disposed thereon, and coupled to the motor 22, for controlling the motor 22, and one or more batteries 26 attached thereto, and coupled to the motor 22 and/or the electric control box 24, for controlling the motor 22 and/or the electric control box 24. The table 20 may further include one or more handles 27 disposed thereon for being grasped by the users, or for retaining the users on the table 20, or the like.

Figure 5:
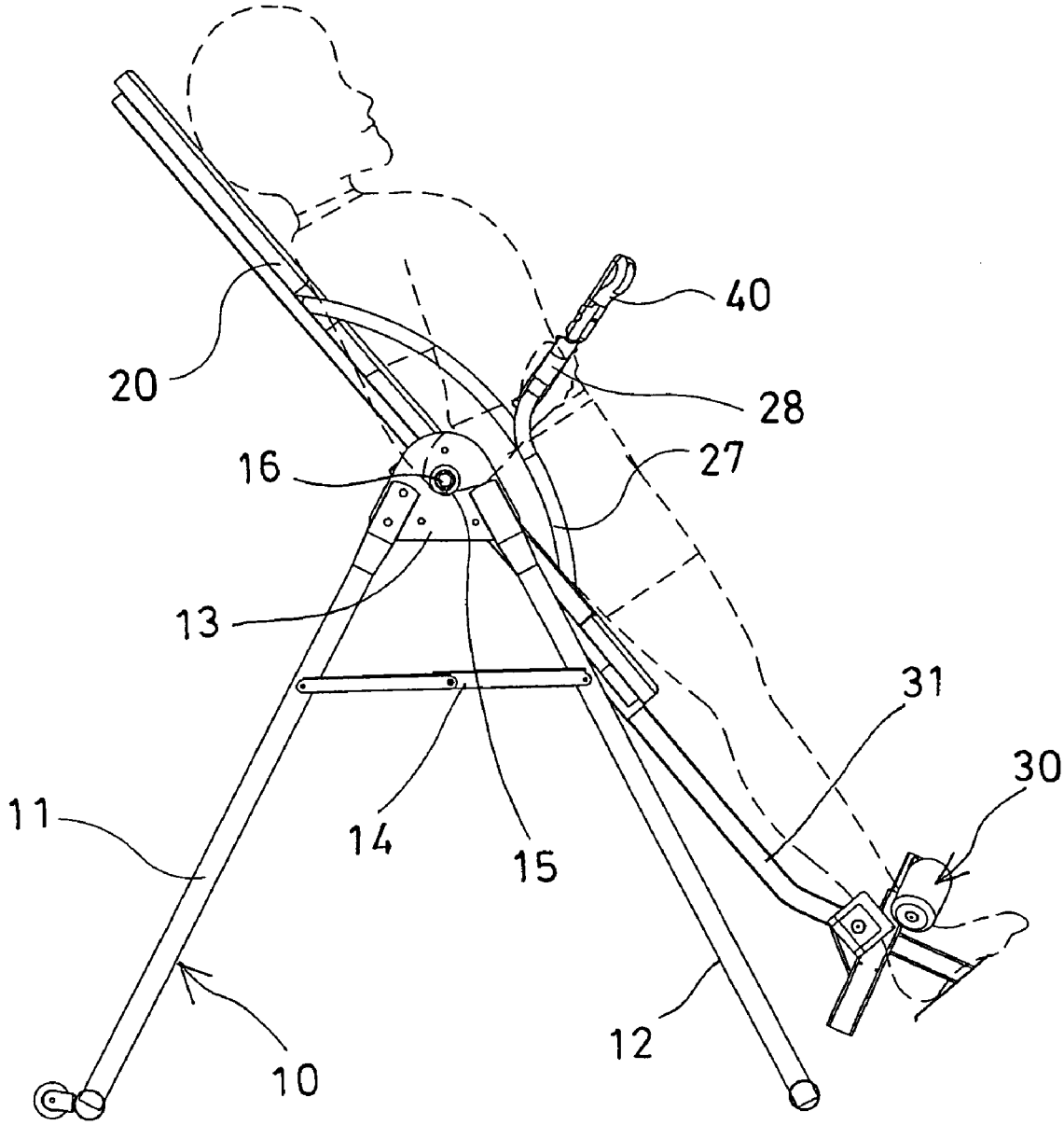
FIGS. 5, 6, 7 are side plan views illustrating the operation of the tilting inversion exerciser.
Figure 6:
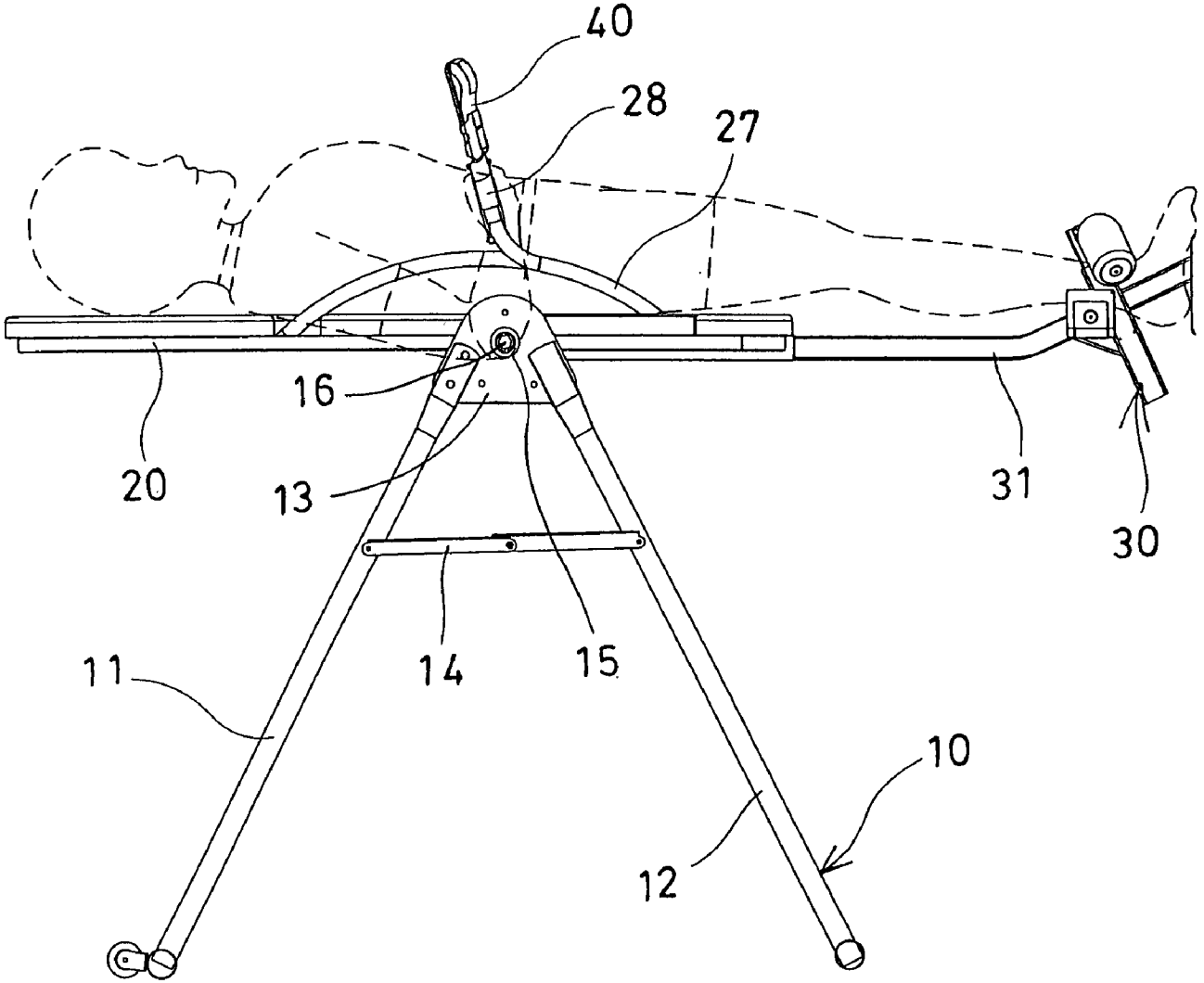
Figure 7:
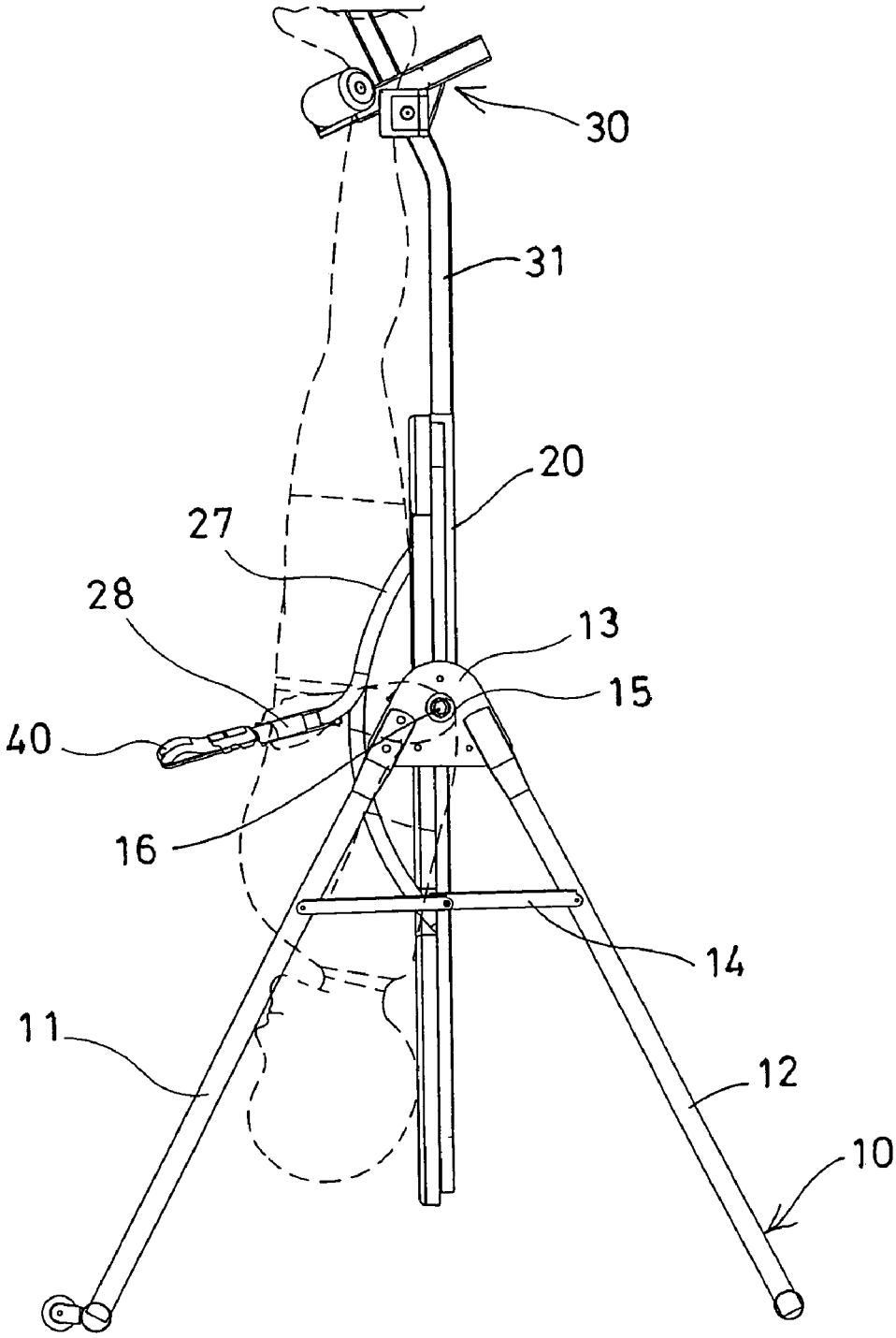
Figure 8:
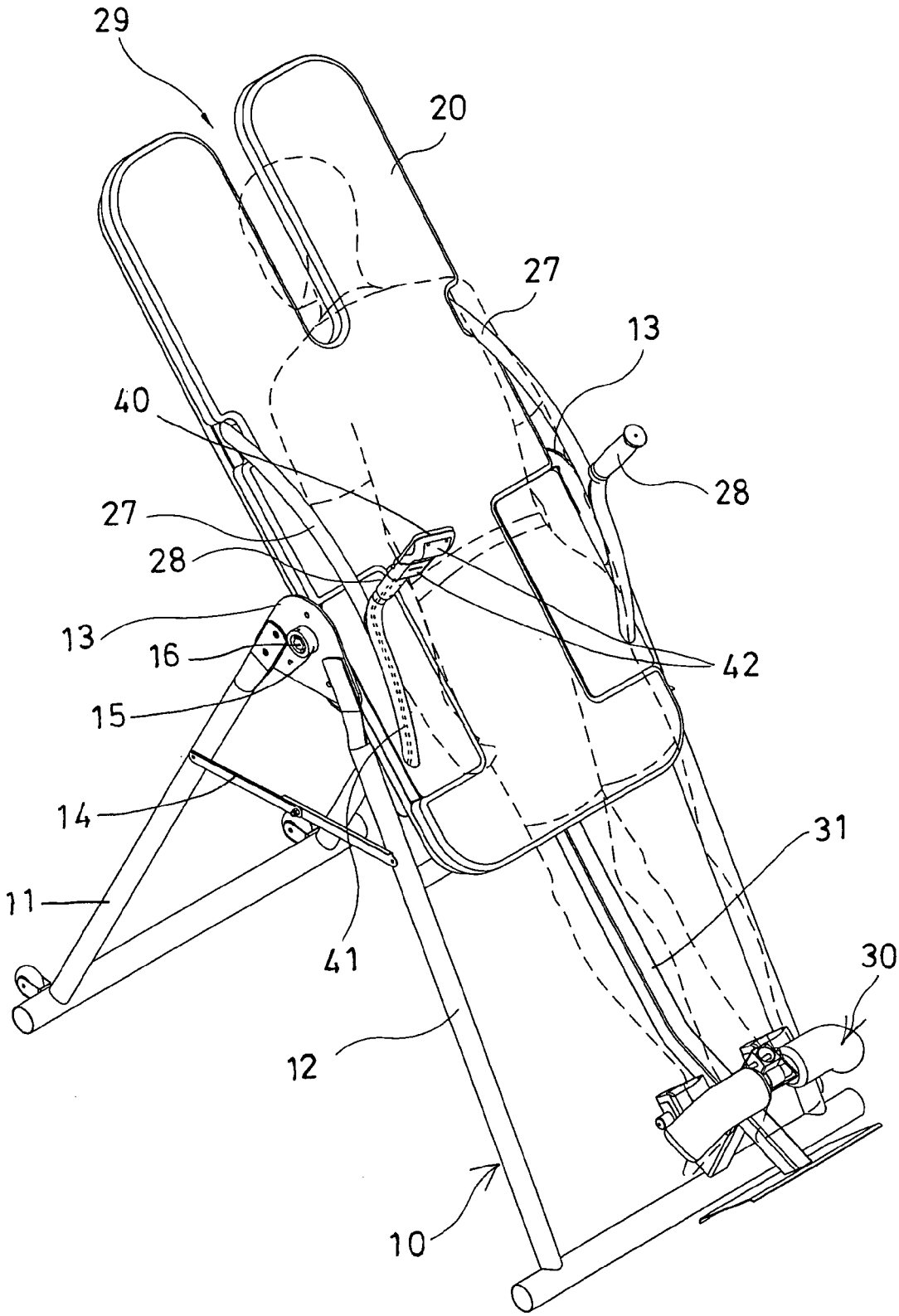
FIG. 8 is a perspective view illustrating the operation of the tilting inversion exerciser.

The table 20 further includes one or more, such as two hand grips 28 disposed thereon, and directly extended therefrom, or indirectly extended from the handles 27 respectively, for being grasped by the users (FIG. 5). The table 20 may further include an opening 29 formed in one end or upper portion thereof, for receiving the front portion of the head of the user (FIG. 8). The table 20 may further include a foot retaining device 30 attached or coupled thereto with an adjustable extension 31, for holding or retaining or positioning the feet of the users to the table 20.

A control device 40 is attached or secured to one of the hand grips 28, and coupled to the electric control box 24 and/or the motor 22, with an electric cable 41, or via remote control mechanisms, for allowing the users to easily operate or control the electric control box 24 and/or the motor 22 to rotate or to drive the table 20 relative to the stand 10. The control device 40 may include one or more buttons 42 for being depressed or controlled by the users.

It is to be noted that the control device 40 is solidly attached or secured to one of the hand grips 28, and will not be disengaged or separated from the hand grip 28, such that the control device 40 may be easily operated by the users. The electric cable 31 may be engaged through the hand grip 28 and/or the handle 27, and may thus be suitably shielded, without being exposed. The electric control box 24 and/or the motor 22 may be controlled by the control device 40 via the electric cable 41, or via the typical remote control mechanisms. The attachment of the control device 40 to one of the hand grips 28 has been filed in a co-pending patent application, and thus will not be described in further details.

In operation, as shown in FIGS. 2 and 4–8, the user may be stably supported on the table 20, and the feet of the user may be retained or fixed in place by the foot retaining device 28. The users may hold or grasp the hand grips 28, and may easily actuate the control device 40 to rotate or to drive the table 20 relative to the stand 10. The control device 40 has no chance to be disengaged from the hand grips 28 and the table 20, and thus will have no chance to be separated from the users.

It is to be noted that the axles 16 are selectively latched to the hubs 15 of the plates 13 with the latches 18, such that the axles 16 may be prevented from being rotated relative to the hubs 15 of the apex-connecting plates 13. When the motor 22 is energized, the table 20 may be forced to rotate relative to the axles 16 by the motor 22 via the reduction gearing 23, and may be controlled and rotated relative to the stand 10 to any selected angular positions by the control device 40.

It is further to be noted that the reduction gearing 23 is directly engaged onto the axle 16 to which the table 20 is rotated around, such that the table 20 may be effectively rotated or driven by the motor 22 via the reduction gearing 23. The table 20 may also be rotated freely relative to the plates 13 of the stand 10 when the latches 18 are removed or disengaged from the hubs 15.

Figure 3:
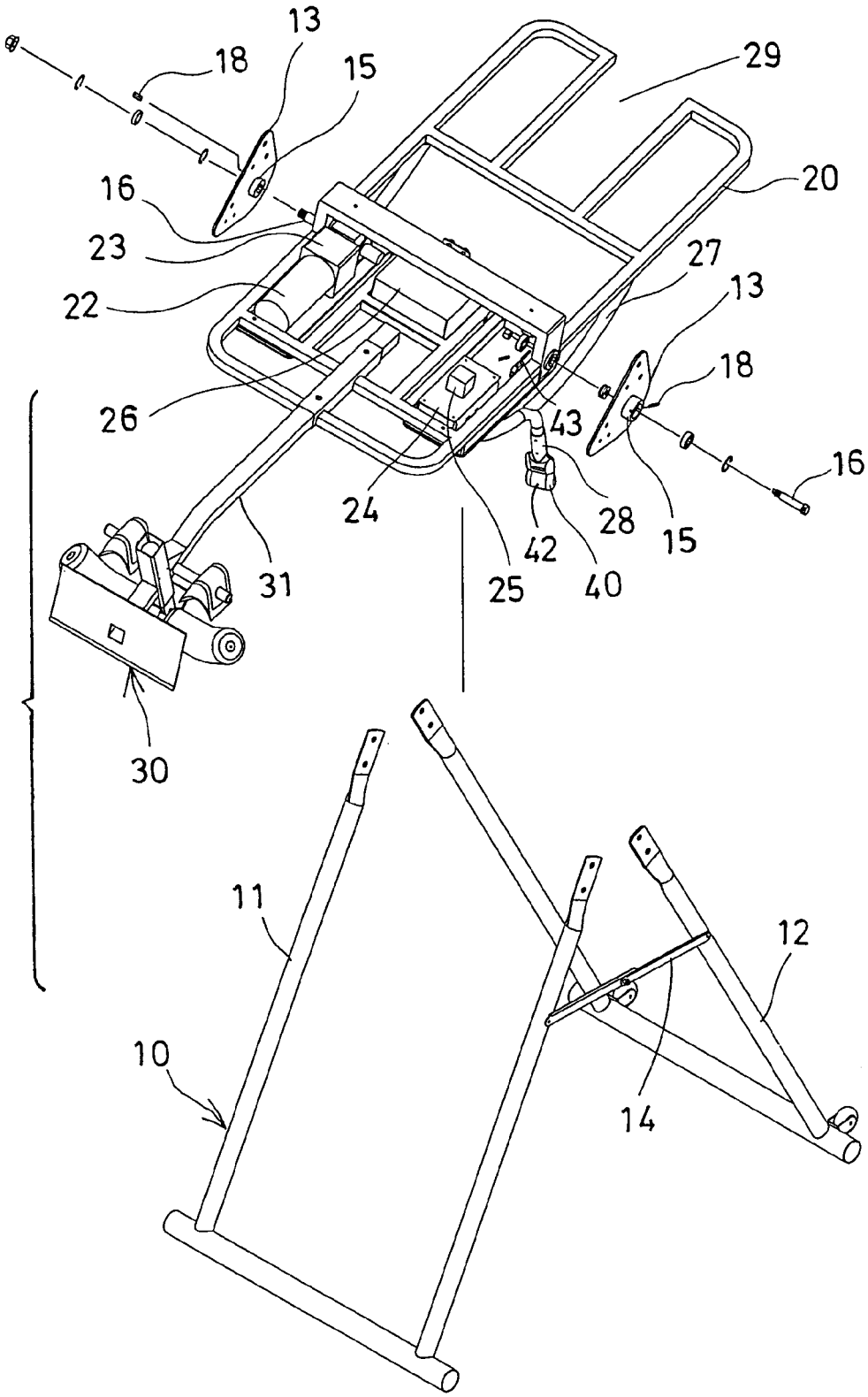
FIG. 3 is an exploded view of the tilting inversion exerciser.
Figure 4:
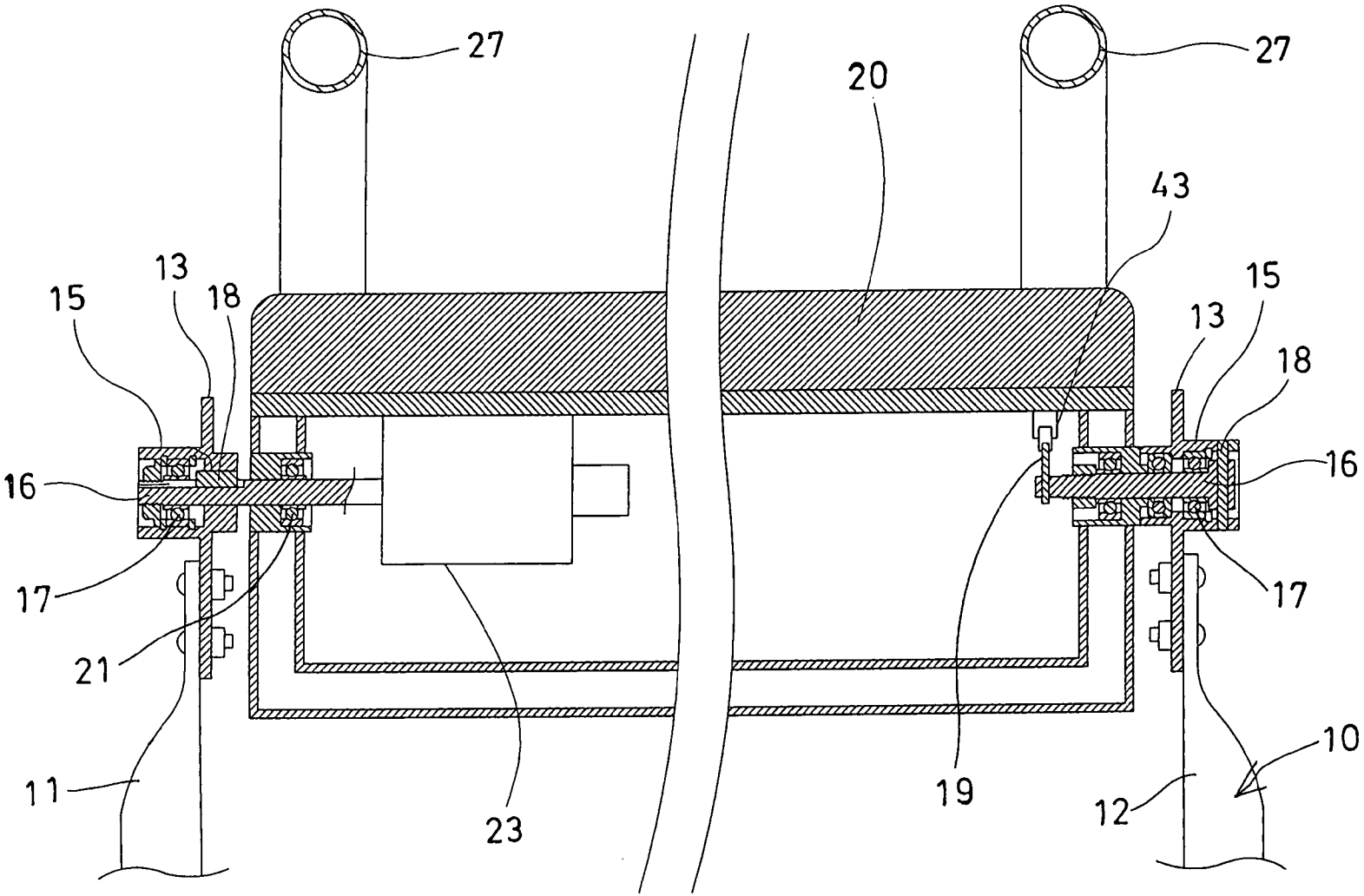
FIG. 4 is a partial cross sectional view taken along lines 4—4 of FIG. 1.

As shown in FIGS. 3–4, a switch 43 may further be provided and attached to the table 20, and an actuator finger 19 may be attached to one of the axles 16 and rotated in concert with the axles 16, for being rotated by the axles 16 to engage with or to actuate the switch 43, particularly when the table 20 has been rotated to a vertical position or other selected angular positions relative to the stand 10 (FIG. 7), in order to stop the motor 22, and to prevent the table from being over-rotated relative to the stand 10.

Accordingly, the tilting inversion exerciser in accordance with the present invention includes a driving motor to drive or to rotate the table relative to the stand to selected angular position, and includes a fixed control device for preventing the fixed control device from being separated from users, and for allowing the fixed control device to be easily operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A tilting inversion exerciser comprising:

a stand including an axle disposed thereon, said stand including a latch engaged with said axle, to secure said axle to said stand, and to prevent said axle from being rotated relative to said stand, and said stand including an apex-connecting plate disposed thereon, to support said axle, said apex connecting plate including a hub where the axle is rotatable received in the hub of the plate, a table including a switch and at least one frame disposed thereon and being rotatably attached to said axle of said stand to support a user, a driving device attached to said table and including a reduction gearing coupled to said axle to drive and rotate said table relative to said stand, and a control device for controlling said driving device to rotate said table relative to said stand, said control device including an electric cable, at least one handgrip for engagement through said electric cable, an actuator device having an actuator finger attached to said axle and rotated in concert with said axle for being rotated by said axle to actuate said switch to stop said driving device and position said table to said stand at selected angular positions, a foot retaining device attached to said table for retaining the feet of a user.

2. The tilting inversion exerciser as claimed in claim 1, wherein said at least one hand grip for being grasped by the user.

3. The tilting inversion exerciser as claimed in claim 2, wherein said table includes at least one frame disposed thereon, and said at least one hand grip is extended from said at least one frame.

4. The tilting inversion exerciser as claimed in claim 3, wherein said electric cable is engaged through said at least one hand grip and said at least one frame.

5. The tilting inversion exerciser as claimed in claim 2, wherein said control device is secured to said at least one hand grip.

6. The tilting inversion exerciser as claimed in claim 1, wherein said stand includes two frames pivotally attached together, and at least one foldable link coupled between said frames to retain said frames in an open position, and to allow said frames to be folded relative to each other to a folding position.

* * * * *